US010919165B2

(12) United States Patent
Hoexum et al.

(10) Patent No.: US 10,919,165 B2
(45) Date of Patent: Feb. 16, 2021

(54) BLADE SET MANUFACTURING METHOD, BLADE SET AND HAIR CUTTING APPLIANCE

(71) Applicant: KONINKLIJKE PHILIPS N.V., Eindhoven (NL)

(72) Inventors: Everhardus Johannes Hoexum, Eindhoven (NL); Willem Maat, Eindhoven (NL); Siegfried Sablatschan, Eindhoven (NL); Martinus Bernardus Stapelbroek, Eindhoven (NL); Roel Alexander Rethmeier, Eindhoven (NL); Geert-Jan (Guus) Darwinkel, Eindhoven (NL); Albert Jan Aitink, Eindhoven (NL); Luc Berntsen, Eindhoven (NL); Daan Hendrik Gosenshuis, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/082,309

(22) PCT Filed: Mar. 8, 2017

(86) PCT No.: PCT/EP2017/055464
§ 371 (c)(1),
(2) Date: Sep. 5, 2018

(87) PCT Pub. No.: WO2017/153482
PCT Pub. Date: Sep. 14, 2017

(65) Prior Publication Data

US 2019/0091883 A1 Mar. 28, 2019

(30) Foreign Application Priority Data

Mar. 8, 2016 (EP) ..... 16159129

(51) Int. Cl.
*B26B 19/06* (2006.01)
*B26B 19/38* (2006.01)
*B26B 19/20* (2006.01)

(52) U.S. Cl.
CPC ..... *B26B 19/06* (2013.01); *B26B 19/3846* (2013.01); *B26B 19/3893* (2013.01); *B26B 19/20* (2013.01)

(58) Field of Classification Search
CPC ... B26B 19/06; B26B 19/063; B26B 19/3846; B26B 19/3893
(Continued)

(56) References Cited

U.S. PATENT DOCUMENTS 4,667,405 A 5/1987 Trichell
5,068,966 A 12/1991 Wahl
(Continued)

FOREIGN PATENT DOCUMENTS

DE 2161809 A1 5/1973
DE 10302998 B4 7/2007
(Continued)

*Primary Examiner* — Jason Daniel Prone

(57) ABSTRACT

A method of manufacturing a blade set assembly, a blade set assembly, and a hair cutting appliance, wherein the method includes providing a base component including a stationary blade, providing a movable component comprising a cutter blade, providing a coupling element, the coupling element being arranged to be interposed between the base component and the movable component, providing a plastic contact bridge, arranging the stationary blade and the cutter blade at a defined relative assembly position, securing the assembly position between the stationary blade and the cutter blade, involving attaching the plastic contact bridge to one of the base component and the movable component, attaching a retaining portion of the coupling element to the other one of the base component and the movable component, and pen-
(Continued)

etrating the plastic contact bridge with at least one insertion end of the coupling element.

20 Claims, 6 Drawing Sheets

(58) Field of Classification Search
USPC ..... 30/194–216, 223, 224
See application file for complete search history.

(56) References Cited

U.S. PATENT DOCUMENTS

| | | | | |
|---|---|---|---|---|
| 5,819,415 | A * | 10/1998 | Bruggers | B26B 19/06 30/216 |
| 6,260,276 | B1 | 7/2001 | Lebherz | |
| 6,308,415 | B1 * | 10/2001 | Sablatschan | B26B 19/06 30/224 |
| 7,234,242 | B2 * | 6/2007 | Yao | B26B 19/06 30/201 |
| 7,340,839 | B2 * | 3/2008 | Oh | B26B 19/06 30/208 |
| 7,350,314 | B2 | 4/2008 | McCambridge | |
| 7,703,210 | B2 * | 4/2010 | Lau | B26B 19/3846 30/196 |
| 7,913,399 | B2 * | 3/2011 | Lau | B26B 19/06 30/194 |
| 8,146,254 | B2 * | 4/2012 | Morisugi | B26B 19/06 30/216 |
| 8,453,333 | B2 * | 6/2013 | Long | B26B 19/06 30/210 |
| 8,479,400 | B2 * | 7/2013 | Fukutani | B26B 19/3846 30/195 |
| 8,713,802 | B2 * | 5/2014 | Fukutani | B26B 19/06 30/208 |
| 8,769,828 | B2 * | 7/2014 | Lau | B26B 19/06 30/208 |
| 8,844,142 | B2 * | 9/2014 | Kammer | B26B 19/3846 30/201 |
| 9,242,385 | B2 * | 1/2016 | Erickson | B26B 19/3846 |
| 9,545,729 | B2 * | 1/2017 | Buck, Jr. | B26B 19/063 |
| 9,676,110 | B2 * | 6/2017 | Lau | B26B 19/3846 |
| 9,770,836 | B2 * | 9/2017 | Werner | B26B 19/063 |
| 10,093,029 | B2 * | 10/2018 | Sablatschan | B26B 19/28 |
| 10,272,578 | B2 * | 4/2019 | Johnson | B26B 19/3846 |
| 10,322,517 | B2 * | 6/2019 | Werner | B26B 19/205 |
| 2006/0042096 | A1 * | 3/2006 | Liao | B26B 19/06 30/223 |
| 2006/0207105 | A1 * | 9/2006 | Alvite | B26B 19/06 30/225 |
| 2007/0144025 | A1 | 6/2007 | McCambridge | |
| 2008/0282550 | A1 * | 11/2008 | Piwaron | B26B 19/06 30/210 |
| 2010/0000093 | A1 * | 1/2010 | Hwang | B26B 19/06 30/42 |
| 2012/0192436 | A1 | 8/2012 | Toy | |
| 2012/0198716 | A1 | 8/2012 | Tonges | |
| 2014/0338199 | A1 | 11/2014 | Erickson | |
| 2015/0209969 | A1 * | 7/2015 | Sablatschan | B26B 19/28 30/216 |

FOREIGN PATENT DOCUMENTS

| | | |
|---|---|---|
| EP | 2926958 A1 | 10/2015 |
| JP | 2006204573 | 8/2006 |

* cited by examiner

BLADE SET MANUFACTURING METHOD, BLADE SET AND HAIR CUTTING APPLIANCE

This application is the U.S. National Phase application under 35 U.S.C. § 371 of International Application No. PCT/EP2017/055464, filed on Mar. 8, 2017, which claims the benefit of International Application No. 16159129.2 filed on Mar. 8, 2016. These applications are hereby incorporated by reference herein.

FIELD OF THE INVENTION

The present disclosure relates to a method of manufacturing a blade set assembly for a hair cutting appliance, to a blade set assembly, and to a hair cutting appliance implementing such a blade set assembly.

More particularly, the present disclosure relates to improvements in hair cutting devices wherein the cutting action is obtained by reciprocating blades, such as clippers and trimmers. More specifically, the present disclosure relates to novel approaches to obtaining an optimal spacing between blades in hair cutting appliances comprising a blade set arrangement involving a movable cutter blade (also referred to as cutter) and a stationary blade (also referred to as guard).

BACKGROUND OF THE INVENTION

Hair cutting appliances, particularly electric hair cutting appliances, are generally known and may include trimmers, clippers and shavers, for instance. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to shave or trim (human) body hair, in particular facial hair and head hair to allow a person to have a well groomed appearance. Frequently, electric hair cutting appliances are used for cutting animal hair.

US 2014/0338199 A1 discloses A hair trimmer comprising a base housing, a motor and a blade set, the blade set having a stationary blade and a reciprocating movable blade, the base housing having a blade set support at one end, a cam follower, a spring, and a spring tensioner that secures the spring under tension, the reciprocating blade being operably secured to the cam follower, and the stationary blade being secured to the base housing.

For a considerable variety of hair cutting and trimming operations it is desirable that the distance between the stationary blade and the cutter blade be at a defined value, preferably as small as possible. More particularly, a distance or an offset between frontal ends of the teeth of the stationary blade and the teeth the cutter blade is preferably as small as possible, but not resulting in an arrangement wherein the frontal ends of the teeth of the cutter blade extend beyond the the frontal ends of the teeth of the stationary blade. The distance or offset involved may be also referred to as tip-to-tip distance.

Accordingly, the teeth of the movable blade are preferably offset (i.e. set back from a contact point with the skin) from the stationary blade. A main motivation for this configuration is to avoid cutting the skin of the person whose hair is being cut or trimmed. Hence, tip-to-tip adjustment often involves a tradeoff between sufficient precision and the likelihood of skin damage. Generally, it is desirable to set the movable blade so that it is offset from the stationary blade by a very small distance.

Manufacturers often set or adjust the tip-to-tip distance of the blade set in the factory, as a part of the assembly procedure. This method has several drawbacks at least some of which are attributable to a resulting remaining tolerance range which may have adverse effects on the above design goals. Due to a lack of precision at the single component level and at the manufacturing stage, and due to some inherent inconsistency in the adjustment procedure, a certain level of remaining assembly tolerances cannot be avoided in accordance with common manufacturing and design approaches. US 2007/0144025 A1 addresses these challenges by providing for a separate calibration gauge for hair cutter blade sets which can be used by end users (home users) so as to calibrate the tip-to-tip distance. However, this involves certain tasks to be performed by the end user and therefore complicates the operation of hair cutting appliances.

There is thus still room for improvement in manufacturing approaches for blade set arrangements of hair cutting appliances.

SUMMARY OF THE INVENTION

It is an object of the present disclosure to provide a method of manufacturing a blade set that tackles at least some of the above discussed issues and that preferably enables a high-precision assembling of blade sets which preferably results in an improved operational performance of a respectively equipped hair cutting appliance. Preferably, the manufacturing method enables to assemble the blade set without huge additional manufacturing efforts. Further, it is desirable to present a blade set assembly method which enables a further reduction of the number of required components and assembly steps. Preferably, blade sets that have been assembled in accordance with the manufacturing method are durable and arranged to be operated at a steady level of performance for a long time. Furthermore, it is desired that no additional adjustment and/or calibration efforts are required at the level of the end user.

Furthermore, it is desirable to provide a corresponding blade set assembly and a hair cutting appliance comprising a respective blade set assembly that are operable at an improved performance level which is at least partially attributable to an improved achievable minimum tolerance range.

In a first aspect of the present disclosure there is presented a method of manufacturing a blade set assembly for a hair cutting appliance, the method comprising the steps of:

providing a base component comprising a stationary blade, particularly a guard blade, providing a movable component comprising a cutter blade, providing a coupling element, particularly a flexible coupling element, the coupling element being arranged to be interposed between the base component and the movable component, providing a plastic contact bridge, arranging the stationary blade and the cutter blade at a defined relative assembly position, and securing the assembly position between the stationary blade and the cutter blade, involving:

attaching the plastic contact bridge to one of the base component and the movable component, attaching a retaining portion of the coupling element to the other one of the base component and the movable component, and penetrating the plastic contact bridge with at least one insertion end of the coupling element.

This aspect is based on the insight that the present tolerance range and the corresponding process capability may be significantly improved by directly bonding the coupling element and the plastic contact bridge without the need of predefining a bonding spot or contact location therebetween. In other words, the at least one insertion end of the coupling element may be urged or driven into (or pushed into or inserted into) the plastic contact bridge exactly at the actual location thereof which is defined by the assumed relative assembly position of the stationary blade and the cutter blade (e.g. by a respective assembly gage). Consequently, it is not necessary to provide and process predefined or pre-set bonding locations at the plastic contact bridge, involving recesses, through-holes, mounting tabs, etc.

By contrast, in accordance with at least some embodiments discussed herein, a plain surface may be provided in which the insertion end of the coupling element may be driven. Similarly to a nail which may be driven into a wall at an arbitrary position, also the insertion and may penetrate the plastic contact bridge at an actual contact position which enables a low-backlash mating, more particularly a free-of-play joint between the coupling element and the plastic contact bridge. Preferably, only little or even no preloading is present between the plastic contact bridge and the coupling element in a direction of interest (i.e. longitudinal direction) in which the tolerance range of interest for the tip-to-tip distance between the stationary blade and the cutter blade is present.

In other words, as the coupling element itself defines the contact and mating position with the contact bridge, respective tolerances and/or deviations in the direction of interest at the coupling element would have no effect or only little effect on the resulting overall tolerance range. Hence, the tolerance range, particularly the tip-to-tip distance tolerance range between the stationary blade and the cutter blade may be significantly improved.

Generally, the plastic contact bridge may be assigned to one of the stationary component, particularly the stationary blade thereof, and the movable component, particularly the cutter blade thereof. Typically, the plastic contact bridge is attached to one of the cutter blade and the stationary blade.

The at least one insertion end of the coupling element penetrates into the plastic contact bridge. Penetrating may involve a displacement of plastic material. The insertion end of the coupling element is arranged to push away or displace plastic material of the contact bridge, thereby forming the joint between the contact bridge and the coupling element.

In conventional manufacturing approaches, for instance a hole or recess would be processed at the level of the contact bridge in which the at least one insertion end of the coupling element would be inserted. Hence, the position of the hole and also the position and shape of the insertion end would increase the resulting tolerance level.

Those influencing factors may be dispensed with by directly bonding or mating the contact bridge and the coupling element through driving the at least one insertion end into the plastic material of the contact bridge at a bonding spot where no hole or recess is predefined.

In accordance with at least some exemplary embodiments, a significant tolerance range reduction for the tip-to-tip distance may be achieved. For instance, a conventional manufacturing approach may result in a tolerance range of about 0.5 mm (millimeter). In accordance with the novel approaches as discussed herein, the tolerance range may be reduced to 0.2 mm, at an excellent process capability level.

In an exemplary embodiment, the plastic contact bridge may be referred to as follower element which is attached to the cutter blade, and which is arranged to be engaged by an (eccentric) cam portion of a driving shaft of the hair cutting appliance. Hence, the coupling element may be received or supported at the base component, and may define a link between the stationary blade and the cutter blade.

In an exemplary embodiment, the coupling element, in an assembled state, defines an offset between a series of teeth of the stationary blade and a series of teeth of the cutter blade. This embodiment involves arrangements wherein a linkage mechanism is provided that defines a combined reciprocating swiveling relative movement path between the stationary blade and the cutter blade, wherein the stationary blade and the cutter blade maintain a parallel orientation to one another, and wherein the offset (tip-to-tip distance) fluctuates in an oscillating fashion. Hence, the offset may be a somewhat floating offset which, however, is preferably within a defined precise range.

In a further exemplary embodiment, the coupling element is a spring element, particularly a leaf spring or wire spring, wherein the insertion end, in the penetrated state, forms a joint with one of the base component and the movable component. Typically, the coupling element is manufactured from metal material. The coupling element is preferably arranged to bias against the stationary blade and/or the cutter blade so as to urge them into a desired relative assembly orientation.

In a further exemplary embodiment, the step of penetrating the plastic contact bridge involves:

at least partially softening the plastic contact bridge, and penetrating the plastic contact bridge at a softened non-perforated section thereof.

Accordingly, bonding the contact bridge and the coupling element is greatly simplified. At least a portion of the plastic contact bridge in which the insertion of the insertion end of the coupling element is expected may be softened so as to "weaken" the contact bridge and to facilitate the bonding operation. As indicated above, the portion of the contact bridge which is penetrated by the insertion end of the coupling element is preferably arranged in a non-perforated continuous fashion. In other words, the insertion end of the coupling element is driven into a massive portion of the contact bridge. The insertion end displaces or squeezes a fraction of the plastic contact portion when being inserted or introduced therein.

In a further exemplary embodiment, a resulting position of a penetration spot at the plastic contact bridge is dependent on (a function of) the desired defined relative assembly position of the stationary blade and the cutter blade. Preferably, the defined relative assembly position, particularly the desired tip-to-tip distance between the stationary blade and the cutter blade, can be kept basically constant (for a plurality of series of assembled blade sets), whereas the step of securing the assembly position between the stationary blade and the cutter blade does not have an adverse effect thereon. Hence, also further inherent manufacturing and assembly tolerances of the blade set assembly may have an influence on the resulting penetration spot at the plastic contact bridge. However, the penetration step may accommodate or compensate a certain share of occurring manufacturing and assembly tolerances when the tip-to-tip distance is set by an assembly gage arrangement. As a result, the overall tolerance range for the desired tip-to-tip distance may be greatly reduced. Preferably, the assembly gage arrangement engages the cutter blade and the stationary blade when the at least one insertion end of the coupling element penetrates the plastic contact bridge.

In a further exemplary refinement, the insertion end of the coupling element is heated, wherein the coupling element, in the heated state of the insertion end, softens the plastic contact bridge. In accordance with this embodiment, the coupling element is at least partially softened through heating. Since the coupling element is preferably made from plastics, heating at least a part thereof does not have an adverse effect on surrounding components of the blade set assembly.

In a further exemplary embodiment, the step of at least partially softening the plastic contact bridge involves heating the at least one insertion end of the coupling element, wherein heating the at least one insertion end preferably involves laser heating or friction heating.

In accordance with this embodiment, the plastic contact portion may be mediately softened. Further, the insertion end itself which is about to be driven into the plastic contact bridge is used to soften the plastic material thereof at the expected contact spot. Since only the contact spot that is actually contacted by the insertion end is considerably heated and softened in accordance with this embodiment, energy consumption and required processing time may be kept at a low level. In addition, the risk of adverse effect on surrounding components may be further reduced due to the precise softening action in the very close proximity of the contact spot.

In a further exemplary embodiment, the coupling element is arranged in a pretension mounting position which induces an insertion force that urges the at least one insertion end into the plastic contact bridge. In accordance with this embodiment, the coupling element itself provides the insertion force. Hence, no external insertion force applying member is required. The need of external actuators for the insertion or penetrating action may be dispensed with. Preferably, the plastic contact bridge is, at least in the vicinity of the contact spots, softened which significantly reduces the required driving or insertion force for introducing the insertion end into the plastic material of the contact bridge.

Hence, assembling the stationary blade and the cutter blade may be accomplished by arranging the coupling element in a pretension fashion, and by applying thermal energy so as to soften a part of the plastic contact bridge.

In a further exemplary embodiment, the coupling element, in the assembled state, urges the movable component into a defined lateral guidance and close fit configuration with the base component. In accordance with this embodiment, the coupling element does not only form a link between the base component, particularly the stationary blade, and the movable component, particularly the cutter blade, but also serves as a guide therebetween.

In one exemplary embodiment, a remainder of the insertion force that urges the insertion end into the plastic contact bridge involves a guide and mating force. Hence, the stationary blade and the cutter blade are not only linked or connected by the coupling element but also urged against one another. This results in an improved cutting performance as the formation of an undesired gap between the stationary blade and the cutter blade, particularly at the teeth thereof, can be avoided. In other words, the remaining pretension of the coupling element is sufficient to set the cutter blade and the stationary blade into a defined sliding contact state.

In a further exemplary embodiment, the step of securing the assembly position between the stationary blade and the cutter blade involves penetrating the plastic contact bridge with a first insertion end of the coupling element, and penetrating the plastic contact bridge with a second insertion end of the coupling element, wherein resulting penetration spots are spaced from one another in such a way that a linkage mechanism for a defined relative movement between the stationary blade and the cutter blade is formed.

This embodiment has the advantage that the coupling element also serves as a linkage mechanism and hence as a guide for the desired relative cutting movement between the stationary blade and the cutter blade.

On the one hand, the coupling element may urge the stationary blade and the cutter blade, particularly respective flat wall portions thereof against one another so as to achieve a tight contact and a significantly small cutting clearance or gap. Further, the coupling element, when being arranged as a linkage mechanism, defines an allowed relative movement range between the stationary blade and the cutter blade.

Preferably, the coupling element is arranged as a flexible or resilient coupling element. Therefore, when the cutter blade is driven so as to generate the relative reciprocating movement between the cutter blade and the stationary blade, the coupling element may flex or deflect accordingly and, at the same time, define the relative orientation between the stationary blade and the cutter blade.

In one exemplary embodiment, the arrangement of the coupling element is, on the functional level, similar to a four-bar linkage mechanism. This involves that the stationary blade forms a first, stationary bar. The movable blade forms a second, movable bar that is opposite to the stationary bar. Between the stationary blade and the cutter blade, opposite deflection arms of the coupling element may be provided which define a third and a fourth bar, respectively. The third bar and the fourth bar may be also referred to as deflectable or swivel bars. When the first deflection arm and the second deflection arm are arranged in a parallel fashion and have basically the same (effective) length, a parallel orientation between the stationary blade and the movable blade is achieved.

Between the movable blade and the deflection arms of the coupling element, hinge joints may be formed when a considerably small torque level is required to move/swivel the insertion ends with respect to their recesses in the engagement regions of the contact bridge. Hence, actuation forces and, as a result, power consumption, may be reduced. Needless to say, in accordance with the above embodiment, at least some joints or hinges of such a four-bar mechanism may be formed by respective flexible or deformable portions of the involved components, particularly of the coupling element. This may involve for instance the presence of living hinges and flexible, deflectable portions.

It is further preferred in this connection that the insertion ends comprise a main extension arranged at an angle of approximately 90° (degrees) with respect to a general movement direction of the movable blade, and with respect to an imaginary plane in which the linkage mechanism is arranged. In this way, the insertion ends may serve as pivot elements. Hence, assuming that in one exemplary embodiment, the deflection arms are arranged basically parallel to the imaginary plane of the linkage mechanism, the insertion ends may be formed as a basically perpendicular extension of the deflection arms.

In a further exemplary embodiment, end portions or end faces of the insertion ends are arranged in a basically rotationally symmetric fashion which may involve a curved spherical end and/or a flat circular end, for instance. Accordingly, ease of (rotational) movement of the insertion ends with respect to the contact bridge and/or the cutter blade may be improved.

In a further aspect of the present disclosure there is presented a blade set assembly for a hair cutting appliance, the blade set assembly comprising:

a base component comprising a stationary blade, particularly a guard blade, a movable component comprising a cutter blade, a coupling element, particularly a flexible coupling element, and a plastic contact bridge, particularly a follower element, wherein the stationary blade and the cutter blade are arranged at a defined relative assembly position, wherein the coupling element extends between the base component and the movable component, wherein the plastic contact bridge is attached to one of the base component and the movable component, wherein the bearing portion of the coupling element is attached to the other one of the base component and the movable component, and wherein the at least one insertion end of the coupling element is driven into the plastic contact bridge in a material-displacing fashion, thereby securing the assembly position between the stationary blade and the cutter blade.

Preferably, the blade set assembly in accordance with this aspect is manufactured in accordance with the method as discussed herein before.

The coupling element and the plastic contact bridge are firmly bonded to one another. The attachment of the at least one insertion end of the coupling element and the plastic contact bridge is a material-displacing fashion attachment, this attachment securing the assembly position between the stationary blade and the cutter blade.

The at least one insertion end of the coupling element is inserted or penetrated (or urged, or pushed, or driven) in the plastic material of the contact bridge. A joint defined by the plastic contact bridge and the coupling element is arranged in a low-backlash fashion, preferably in a zero play fashion. At the joint between the insertion end and the plastic contact bridge, basically no mating or assembly clearance is present. Further, a position of the resulting joints between the coupling element and the plastic contact bridge is defined by the present inherent tolerances of the involved components, and by the desired assembly position between the stationary blade and the cutter blade. Hence, the joint defined at the engagement spot between the at least one insertion end and the plastic contact bridge does not urge the involved components into an undesired restricted relative position and/or orientation.

In an exemplary embodiment, the coupling element is arranged as a leg spring comprising at least one deflection arm, at least one retaining portion, and at least one resilient portion arranged therebetween, wherein the at least one insertion end is arranged at an end of the at least one deflection arm, and wherein the coupling element urges the base component and the movable component against one another.

The at least one insertion end may be arranged as a kinking or bent portion. The retaining portion of the coupling element in this embodiment is retained or received at the base component of the blade set assembly. The resilient portion may be also referred to as flexing portion and/or as a spiral portion. More particularly, the coupling element may be arranged as a leg spring comprising two legs or deflection arms at respective ends thereof, wherein the retaining portion and preferably two resilient portions are arranged therebetween. Between the retaining portion and the two deflection arms of the spring in accordance with this embodiment, a defined torque may be generated. Preferably, the coupling element urges the base component and the movable component into a tight sliding fit arrangement.

In further exemplary embodiment, the coupling element, the base component and the movable component define a linkage mechanism that defines a parallel relative moment setting between the base component and the movable component, wherein the coupling element comprises two deflection arms that connect the base component and the movable component. Hence, in accordance with this embodiment, the linkage mechanism formed by the coupling element, the base component and the movable component may resemble a four-bar linkage mechanism. So as to define a parallel orientation between the base component and the movable component, the deflection arms may have basically the same (effective) length.

At the linkage mechanism, the respective joints may be arranged as integrally shaped joints or living hinge joints. Consequently, the joints do not necessarily have to be formed by discrete bearings involving two discrete elements that are arranged to rotate or swivel against one another. However, in at least some embodiments it is preferred that the insertion ends of the deflection arms are arranged to swivel or rotate in their recesses at the contact bridge. This may be the case even when initially a relatively rigid bonding is provided through the insertion operation.

In further exemplary embodiment, the plastic contact bridge is a follower element that is attached to the movable component, wherein the retaining portion of the coupling element is attached to a retaining section of the base component.

By way of example, the plastic contact bridge may be arranged as a snap-on or snap-in element configured to be coupled with the cutter blade. The follower element may be also referred to as cam follower element. The follower element may be engaged by a driving shaft of the hair cutting appliance. Typically, the driving shaft is arranged as a rotating driving shaft and comprises at least one eccentric cam portion which engages the follower element. Hence, at the joint defined by the follower element and the driving shaft, a rotating input movement is transferred into a basically longitudinal reciprocating translation.

However, as already discussed herein before, in accordance with at least some embodiments, a linkage mechanism between the cutter blade and the stationary blade is provided which enables a combined oscillating movement therebetween which involves a somewhat curved reciprocating movement path.

In a further aspect of the present disclosure there is presented hair cutting appliance comprising a blade set assembly in accordance with at least one embodiment as disclosed herein.

Preferably, the hair cutting appliance is a hand-held electrically powered hair cutting appliance. Typically, the hair cutting appliance comprises an elongated housing and a cutting head at a top end thereof where the blade set is provided. Typically, the blade set comprises at least one stationary blade and at least one movable cutter blade that is operable to be moved with respect to the stationary blade to cut hair. The elongated housing further comprises a bottom end which is opposite to the top end thereof. Further, a front side and a rear side are provided. When the hair cutting appliance is in operation, typically the top side, where the blade set is arranged, contacts the to-be-groomed skin portion in a direct or mediate (i.e. via an attachment comb) fashion. The front side is typically facing the skin portion, when the appliance is in use. Consequently, the rear side is typically facing away from the skin when the hair cutting appliance is in operation.

When the hair cutting appliance is in operation, the stationary blade is not moved in a reciprocating fashion with respect to a housing thereof. Rather, the cutter blade is operated and moved with respect to the stationary blade and with respect to the housing in a reciprocating fashion. As a result, a relative movement between the stationary blade and the cutter blade is generated for the hair cutting operation.

Preferred embodiments of the disclosure are defined in the dependent claims. It should be understood that the claimed method can have similar preferred embodiments as the claimed blade set assembly and the claimed appliance and as defined in the dependent system/device claims, and vice versa.

BRIEF DESCRIPTION OF THE DRAWINGS

These and other aspects of the disclosure will be apparent from and elucidated with reference to the embodiments described hereinafter. In the following drawings

DETAILED DESCRIPTION OF THE EMBODIMENTS

Figure 1:
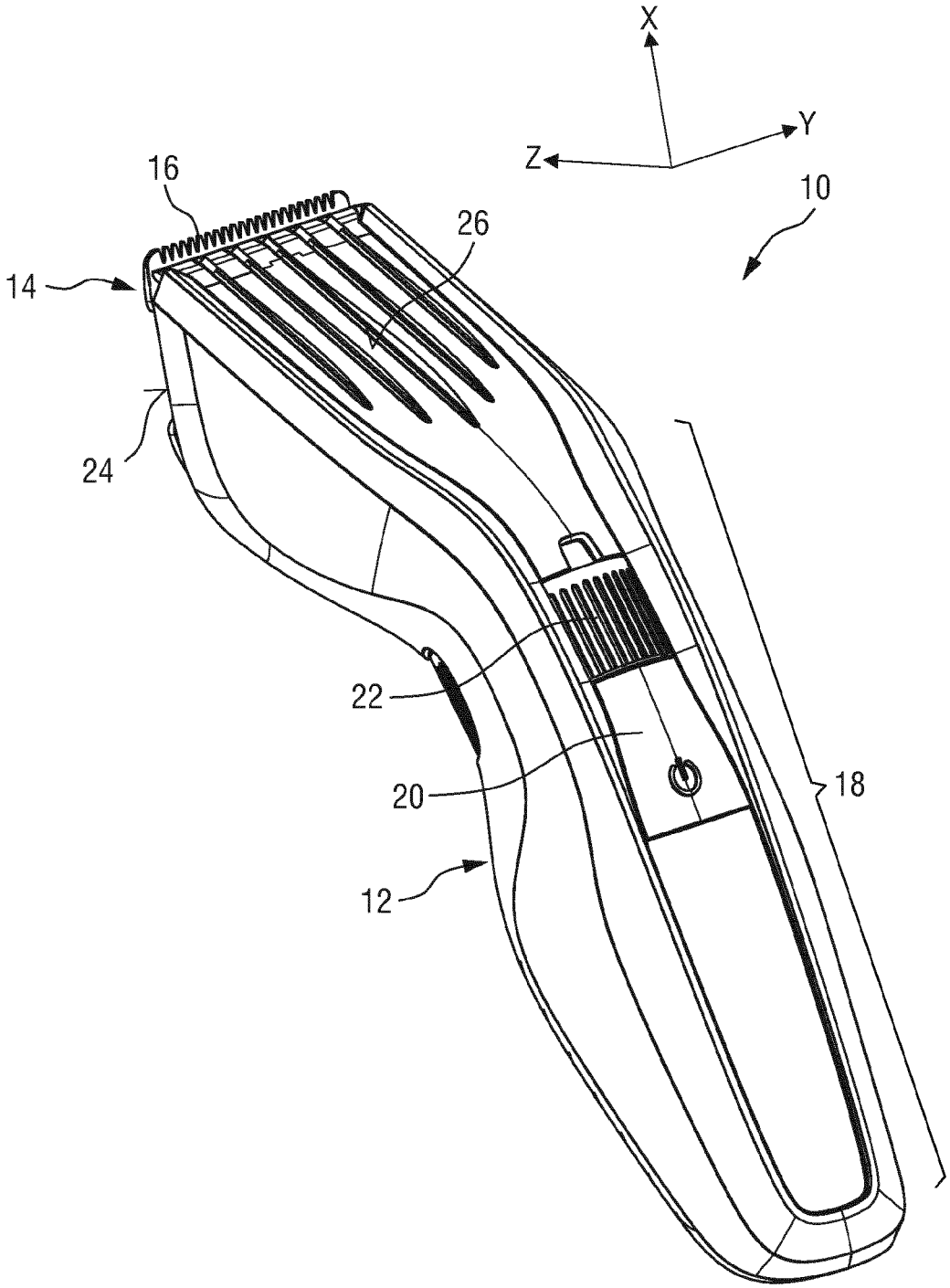
FIG. 1 shows a schematic perspective view of an exemplary embodiment of an electric hair cutting appliance.

FIG. 1 shows a schematic perspective rear view of a hair cutting appliance 10, particularly an electrically operated hair cutting appliance 10. The appliance 10 may also be referred to as hair clipper or hair trimmer. The appliance 10 comprises a housing or housing portion 12 having a generally elongated shape. At a first, top end thereof, a cutting head 14 is provided. The cutting head 14 comprises a blade set assembly 16. The blade set assembly 16 comprises a movable blade 52 and a stationary blade 34 (refer to FIG. 3) that may be moved with respect to each other to cut hair. At a central portion and a second, bottom end of the housing 12, a handle or grip portion 18 is formed. A user may grasp or grab the housing 12 at the grip portion 18.

The appliance 10 in accordance with the exemplary embodiment of FIG. 1 further comprises operator controls. For instance, an on-off switch or button 20 may be provided. Furthermore, in case the appliance 10 is provided with a comb length adjustment mechanism, a length adjustment control 22 may be provided at the housing 12 of the appliance 10. In the embodiment of FIG. 1, the length adjustment control 22 is arranged as a length adjustment wheel.

A front side of the housing portion 12 is indicated in FIG. 1 by reference numeral 24. An opposite rear side is indicated by reference numeral 26. Consequently, for illustrative purposes, the housing 12 of the hair cutting appliance 10 comprises a top side, where the blade set assembly 16 is mounted, a bottom side that is opposite to the top side, a front side 24 which typically faces the skin of the to-be-groomed subject when the appliance 10 is in operation, and a rear side 26 that is opposite to the front side 24.

As shown in at least some Figures discussed herein, for illustrative purposes, a coordinate system (Cartesian coordinate system) X-Y-Z is provided. The coordinate system X-Y-Z is used in the following for describing orientations and locations of components of the hair cutting appliance 10, particularly of the blade set assembly 16 thereof. However, as can be already seen from FIG. 1, not in each case a perfect match of components or parts of the appliance 10 with any of the axis X-Y-Z is provided. By way of example, the housing 12 may exhibit an elongated but somewhat curved shape for ergonomic and design reasons. Therefore, a main elongation direction of the housing 12 does not perfectly match the direction of the X-axis and the Z-axis, but will be rather somewhat inclined or curved in relation thereto. It goes without saying that the skilled person is capable of adapting or, if necessary, transforming or converting the coordinate system X-Y-Z when being confronted with new embodiments, illustrations and/or orientations as the coordinate system X-Y-Z is merely an illustrative means for describing elements of the presented exemplary embodiment of the appliance 10 and their interrelation.

For illustrative purposes, the X-axis will be hereinafter associated with a longitudinal or length direction. Accordingly, the Y-axis will be hereinafter associated with a lateral or width direction. Accordingly, the Z-axis will be hereinafter associated with a height or vertical direction. The coordinate system X-Y-Z describes main extension directions of the blade set assembly 16.

Figure 2:
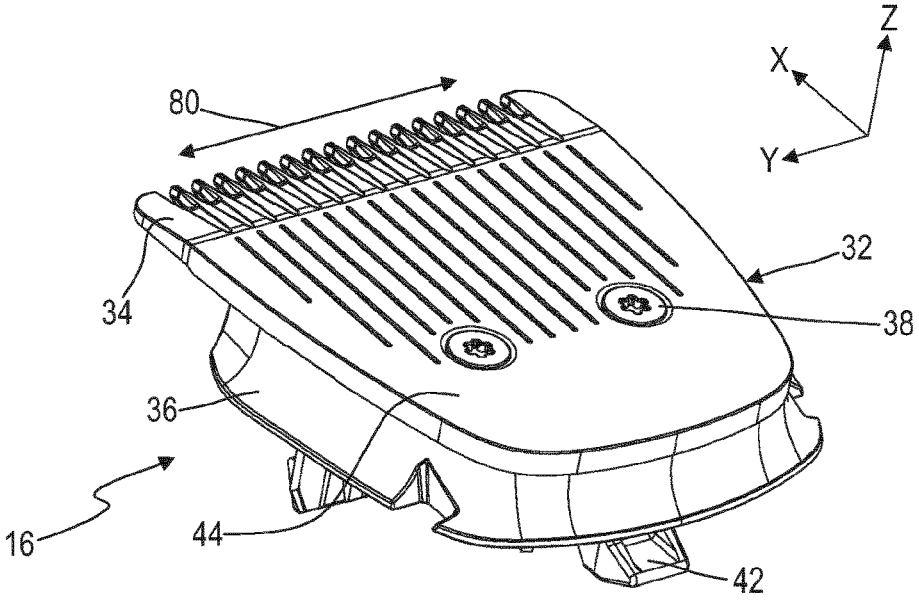
FIG. 2 shows a perspective top view of an exemplary embodiment of a blade set assembly.
Figure 3:
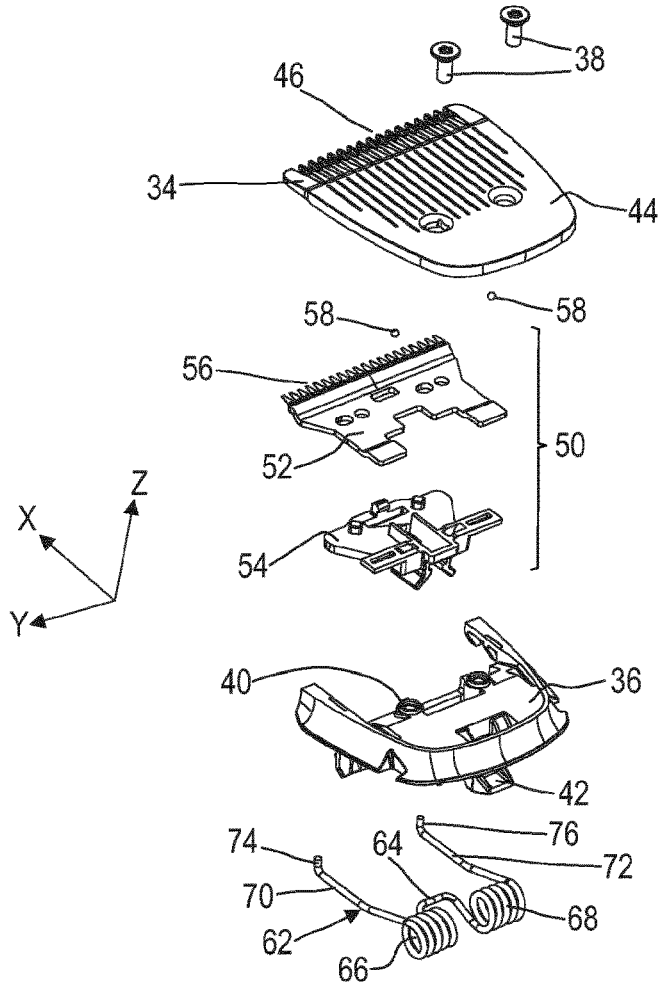
FIG. 3 shows a exploded view of the blade set assembly of FIG. 2 in a reduced size representation.
Figure 4:
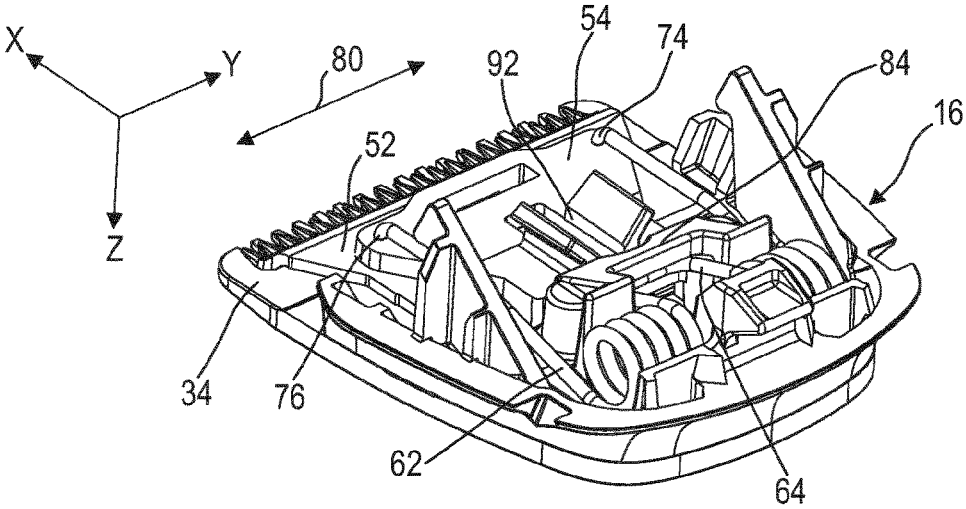
FIG. 4 shows a perspective bottom view of the blade set assembly of FIG. 2.
Figure 5:
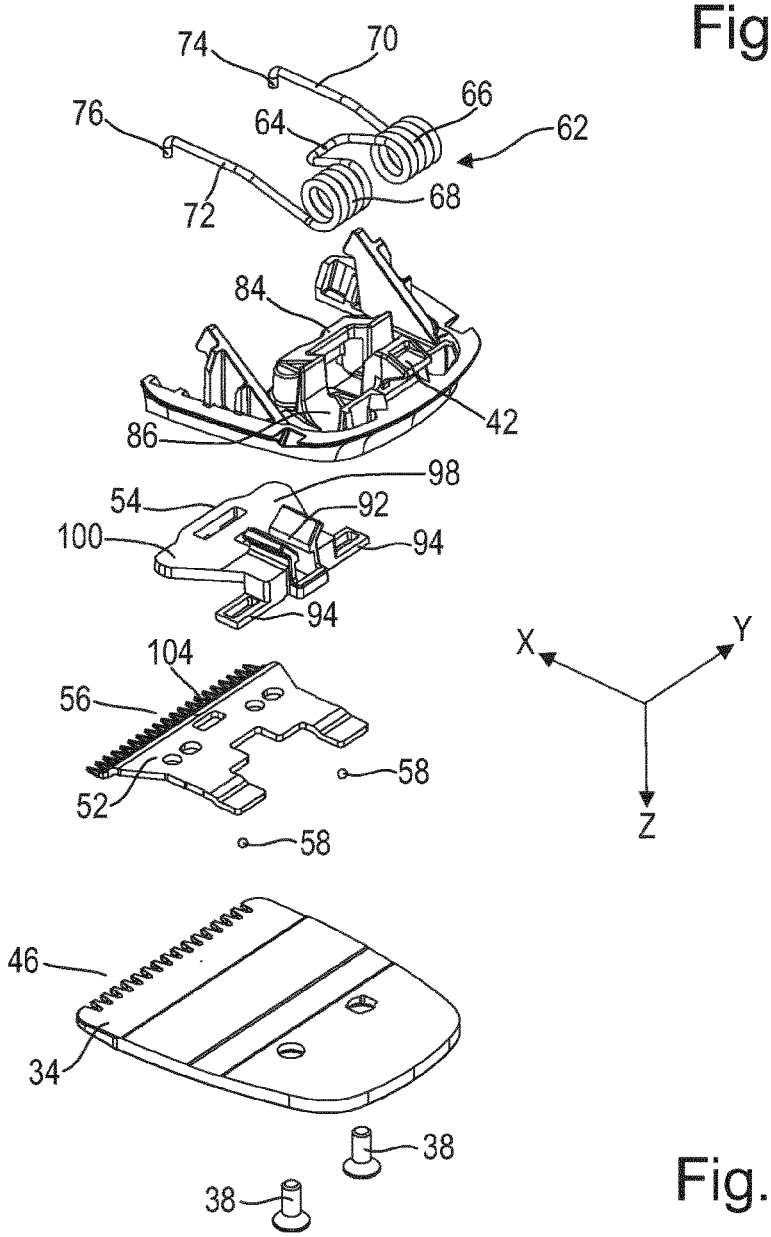
FIG. 5 shows an exploded view of the arrangement of FIG. 4 in a reduced size representation.

With particular reference to FIGS. 2 to 5, an exemplary arrangement of a blade set assembly 16 for a hair cutting appliance 10 will be explained and further detailed. FIG. 2 is a perspective top and front view. FIG. 3 is an exploded view of the arrangement of FIG. 2. FIG. 4 is a perspective bottom and rear view. FIG. 5 is an exploded view of the arrangement of FIG. 4.

The blade set assembly 16 illustrated in FIGS. 2 to 5 is arranged to be coupled with a housing 12 of a hair cutting appliance 10, refer also to FIG. 1.

The blade set assembly 16 comprises a base component 32 which is, when the appliance 10 is operated, attached to the housing 12 thereof which may involve a fixed or firm attachment. The base component 32 comprises a stationary blade 34 and a support part 36. The stationary blade 34 may be also referred to as guard. The support part 36 may be also referred to as support frame. The stationary blade 34 is attached to the support part 36 by fasteners 38 which engage corresponding recesses 40 at the support part 36, refer also to FIG. 3. In the illustrated exemplary embodiment, the fasteners 38 are arranged as screws.

The support part 36 comprises mounting features 42 through which the support part 36 and, consequently, the base component 32, may be attached to the housing 12 in a detachable fashion, at least in some embodiments.

The stationary blade 34 comprises a toothed section comprising a series of teeth 46. Further, a support wall 44 is provided. The toothed section extends from the support wall 44 in the longitudinal direction X.

The blade set assembly 16 further comprises a movable component 50, refer to FIG. 3. The movable component 50 comprises a cutter blade 52. Further, in the exemplary embodiment of FIGS. 2 through 5, the movable component 50 further comprises a contact bridge 54 which is preferably arranged as a plastic contact bridge. Further, at the cutter blade 52, a toothed section comprising a series of teeth 56 is provided. The teeth 46 of the stationary blade 34 and the teeth 56 of the cutter blade 52 are moved with respect to one another in a reciprocating fashion when the blade set assembly 16 is operated, refer also to the double arrow 80 in FIG. 2 and in FIG. 4.

The contact bridge 54 may be also referred to as driving bridge. More generally, the contact bridge 54 may be referred to as contact element. In at least some embodiments, the contact bridge 54 is attached to or forms a part of the movable component 50. However, the tolerance accommodating joint between the coupling element 62 and the respective plastic contact bridge 54 may be also formed at the base component 32 in alternative embodiments.

As can be best seen in FIG. 3 and in FIG. 5, bearing balls 58 may be provided is exemplary embodiments as a bearing means for facilitating the relative movement between the stationary blade 34 and the cutter blade 52.

So as to secure and define a relative assembly position between the stationary blade 34 and the cutter blade 52, a coupling element 62 is provided which is arranged as a spring element. More particularly, the coupling element 62 may be arranged as a leg spring element. At the coupling element 62, a retaining portion 64 is provided which may be also referred to as retaining arm or retaining bracket. The retaining portion 64 is arranged at a central portion of the coupling element 62. Adjacent to the retaining portion 64, a first spiral portion 66 and a second spiral portion 68 is provided. The spiral portions 66, 68 may be also referred to as resilient or flexible portions.

At a first lateral side of the coupling element 62, a first deflection arm 70 is provided. At a second lateral side of the coupling element 62, a second deflection arm 72 is provided. A first insertion end 74 is provided at the first deflection arm 70. A second insertion end 76 is provided at the second deflection arm 72. The deflection arms 70, 72 and, consequently, the insertion ends 74, 76 are spaced away from one another in the lateral direction Y. In the embodiment as shown in FIGS. 2 to 5, the spiral portions 66, 68 define a common axis which is basically parallel to the lateral direction Y. The deflection arms 70, 72 basically extend in the longitudinal direction X, at least in the neutral orientation of FIGS. 3 and 5. The insertion ends 74, 76 basically extend in the height (vertical) direction Z. Needless to say, alternative embodiments and arrangements of the coupling element 62 may be envisaged, involving non-wire spring element, for instance flat spring elements, plastic spring elements, and composite metal-plastic spring elements.

The coupling element 62 secures and maintains a defined relative orientation between the stationary blade 34 and the cutter blade 52 which also applies when the blade set assembly 16 is operated involving a movement of the cutter blade 52 in a reciprocating fashion in the movement direction 80 with respect to the stationary blade 34. Hence, at least the deflection arms 70, 72 are swiveled or deflected when the blade set assembly 16 is operated. As a consequence, the insertion ends 74, 76 are reciprocatingly moved along with the cutter blade 52, wherein a movement path of the insertion ends 74, 76 is substantially parallel to the lateral direction Y but also involves a small component in the longitudinal direction X, as will be discussed further below in more detail.

As can be best seen in FIG. 4, the insertion ends 74, 76 of the coupling element 62 engage (or is inserted in) the contact bridge 54 which is attached to the cutter blade 52. This may involve that the insertion ends 74, 76 are driven into the contact bridge 54.

Further, as can be best seen in FIG. 4 and in the corresponding exploded view of FIG. 5, the retaining portion 64 of the coupling element 62 is, in the mounted state, retained by or supported at a retaining section 84 of the support part 36. The retaining section 84 may be also referred to as retaining recess or retaining seat. Further, a respective receiving recess or mounting recess 86 for each of the spiral portions 66, 68 of the coupling element 62 is provided at the support part 36. As can be already concluded from the arrangement of FIG. 4, when the coupling element 62 is received at the base component 32 which involves that the retaining portion 64 of the coupling element 62 is received at the retaining section 84 in a pre-tensioned or preloaded fashion, a resulting torque or force at the deflection arms 70, 72 may be generated. Typically, the retaining portion 64 and the deflection arms 70, 72 of the coupling element 62 tend to move (swivel) away from one another and to rotate in an opposite fashion, thereby "unwinding" the spiral or coil portions 66, 68.

Figure 6:
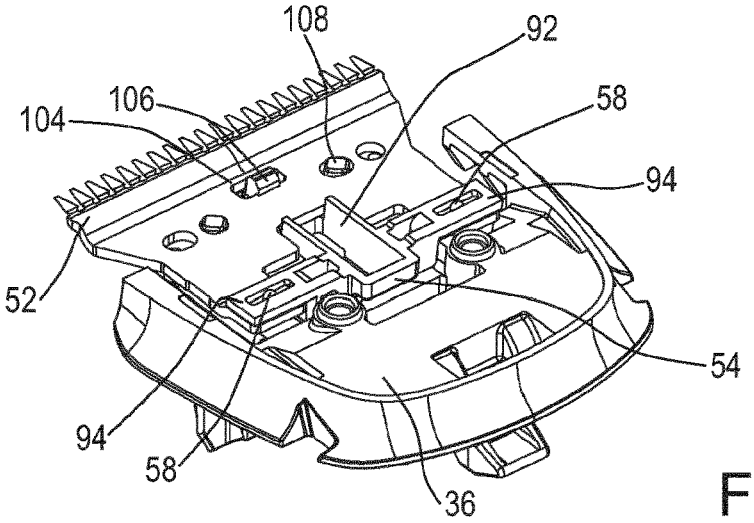
FIG. 6 shows a perspective view of the blade set assembly in accordance with the view of FIG. 2, wherein components are omitted in FIG. 6 for illustrative purposes.

With reference to FIG. 4, FIG. 5 and to FIG. 6, the plastic contact bridge 54 which is engaged by the coupling element 62 in the assembled state of the blade set assembly 16 is further detailed.

FIG. 6 is a view that is basically similar to the view of FIG. 2, wherein, for illustrative purposes, the stationary blade 34 and the fasteners 38 are omitted. Hence, an interior of the blade set assembly 16 is visible. As can be deduced from FIG. 6, the bearing balls 58 are received in guide openings 94 of the contact bridge 54. In the fully assembled state of the blade set assembly 16, the bearing balls 58 are arranged between the stationary blade 34 and the cutter blade 52 and guided for lateral movement by the guide openings 94. Hence, sliding friction between the cutter blade 52 and the stationary blade 34 may be significantly reduced, particularly at a portion thereof that is rearwardly spaced away from a cutting zone that is defined by the respective teeth 56, 46 of the cutter blade 52 and the stationary blade 34 (refer also to the cross-sectional view of FIG. 11 in this context).

At the contact bridge 54, further a follower 92 is formed. The follower 92 may be also referred to as cam follower. The follower 92 as shown in the exemplary embodiment comprises a funnel section so as to simplify the mounting procedure of the blade set assembly 16. The follower 92 is arranged to be engaged by a driving shaft of a drive train (not explicitly shown) of the haircutting appliance 10. Typically, such a driving shaft involves an eccentric cam portion which revolves when the driving shaft is rotated. Between the eccentric cam portion and the follower 92, a joint is formed which translates the revolving input movement into a substantially reciprocating output movement of the cutter blade 52.

Main embodiments and aspects of the present disclosure relate to the connection or joint between the coupling element 62 and the contact bridge 54. In FIG. 3 and FIG. 5, the contact bridge 54 is shown in a non-engagement state. At the contact bridge 54, engagement regions 98, 100 are provided. The engagement region 98 is associated to the insertion end 74. The engagement region 100 is associated to the insertion end 76. The engagement regions 98, 100 define a possible contact region where the insertion ends 74, 76 may penetrate the contact bridge 54, as already discussed herein before.

As can be best seen in FIG. 5, the engagement regions 98, 100 do not comprise a predefined or pre-processed mounting recess or a similar position indication. Rather, the engagement regions 98, 100 are basically non-perforated and extend in an basically continuous, even and non-interrupted fashion in such a way that the insertion ends 74, 76 are not urged into a predefined penetration spot setting.

The contact bridge 54 may be arranged to be attached to the cutter blade 52 in a snap-on or snap-in fashion. Consequently, snap-on features 104 are provided at the cutter blade 52. Corresponding snap-on features 106 are provided at the contact bridge 54. As can be best seen in FIG. 6 and in FIG. 10, the snap-on features 104 of the cutter blade 52 involve respective holes or recesses. The snap-on features 106 of the contact bridge 54 involve deflectable snap-on hooks. Further, positional alignment features 108 may be provided at the cutter blade 52 and the contact bridge 54 to ensure a defined relative assembly position and orientation of the cutter blade 52 and the contact bridge 54.

Figure 7:
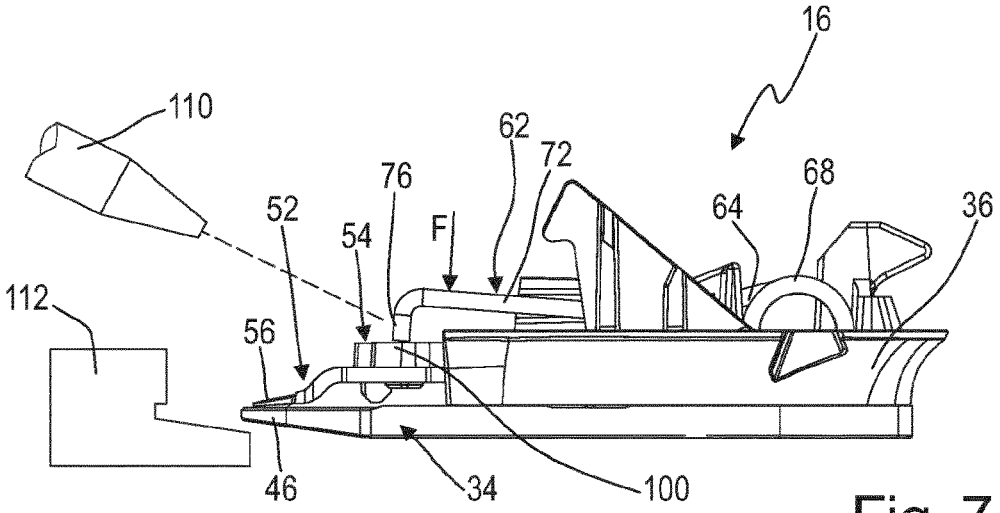
FIG. 7 shows a lateral view of an embodiment of a blade set assembly in a manufacturing configuration.
Figure 8:
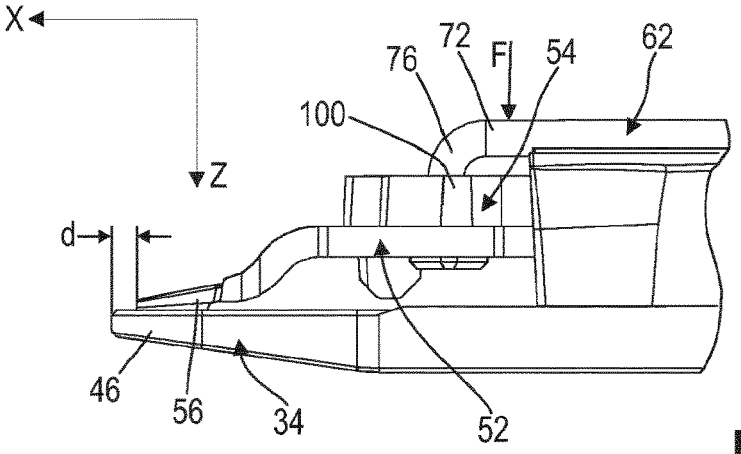
FIG. 8 shows a detail view of the arrangement of FIG. 7 in a resulting assembled configuration.

With reference to FIG. 7 and FIG. 8, an engagement or bonding procedure for the coupling element 62 and the contact bridge 54 is illustrated. FIG. 7 is a side view of the blade set assembly 16 in a subassembly state. FIG. 8 is a detail view of a frontal end of the blade set assembly 16 as shown in FIG. 7 in an assembled and bonded state.

As indicated by d in FIG. 8, a frontal distance in the longitudinal direction between the teeth 46 of the stationary blade 34 and the teeth 56 of the cutter blade 52 is provided. The distance d is somewhat crucial for the operating performance of the blade assembly 16. The offset d may be also referred to as tip-to-tip distance. Preferably, the teeth 46 of the stationary blade 34 slightly extend beyond the longitudinal extension of the teeth 56 of the cutter blade 52, as shown in FIG. 8. As already indicated above, defining and setting the distance d is in some respect a tradeoff between the risk of skin injuries and the cutting performance, particularly the styling performance of a respective appliance 10. It is therefore desirable to bring the distance d close to a minimum positive offset between the stationary blade 34 and the cutter blade 52 while ensuring that the teeth 56 of the cutter blade 52 do not protrude beyond the teeth 46 of the stationary blade 34 in the longitudinal direction X.

As indicated in FIG. 7 by reference numeral 112, a gage may be provided in the assembly line for the blade set assembly 16. The gage 112 may define a desired offset d between the frontal ends of the teeth 56 and 46. So as to secure or "lock" the desired setting between the cutter blade 52 and the stationary blade 34, it is proposed to drive or insert the insertion ends 74, 76 of the coupling element 62 into the contact bridge 54 in a penetrating or squeezing fashion. Therefore, the bonding or mating process between the coupling element 62 the contact bridge 54 does not require any predefined recess or positional indication for the insertion ends 74, 76. Hence, involved manufacturing tolerances of the coupling element 62 and of further involved components of the blade set assembly 16 may be accommodated and compensated. The "recess" or "hole" that is formed by the penetrating insertion ends 74, 76 is, as a matter of course, positioned in a precise and accurate fashion involving a great reduction of the resulting tolerance range for the tip-to-tip distance d.

As indicated in FIG. 7 by an arrow F, a bending force or torque is provided by the coupling element 62 as the retaining portion 64 is received in a preloaded fashion at the retaining section 84 of the support part 36. Given the exemplary illustrative arrangement of FIG. 7, the retaining portion 64 would tend to rotate in a clockwise direction, whereas the deflection arm 72 would tend to rotate in a counter clockwise direction. Needless to say, alternative embodiments and view orientations may involve opposite rotation directions.

Due to the pretension of the coupling element 62, the insertion end 76 at the deflection arm 72 is urged against the engagement region 100 of the contact bridge 54. So as to facilitate the penetration action, it is proposed to soften the engagement region 100.

In an exemplary embodiment, it is proposed to soften the engagement region 100 through heating. More particularly, in at least some embodiments as discussed herein, the engagement region 100 of the contact bridge 54 is mediately heated and softened by heating the insertion end 76 of the coupling element 62.

As indicated in FIG. 7 by reference numeral 110, a non-contact heat source may be provided. For instance, the heat source 110 may be arranged as a laser-based heat source. Alternative heat sources may be envisaged, involving for instance friction heating sources, particularly ultrasonic heating sources. Typically, the coupling element 62 is made from a metal material, particularly from a steel material. The contact bridge 54 is typically made from an injection-moldable plastic material. Hence, a softening temperature of the contact bridge 54 is much lower than any temperature that would soften the metal material of the coupling element 62. As a result, the insertion end 76 of the coupling element 62 acts as a heated and pushing spike or drift that softens and penetrates the plastic material at the engagement region 100 of the contact bridge 54.

As a result, as shown in FIG. 8, the insertion end 76 penetrates the engagement region 100 and thereby forms a firm bonding between the coupling element 62 and the contact bridge 54. Preferably, at least in some embodiments, the gage 112 arrangement engages the cutter blade 52 and the stationary blade 34 when the at least one insertion end 74, 76 of the coupling element 62 is driven into the plastic contact bridge 54.

Figure 10:
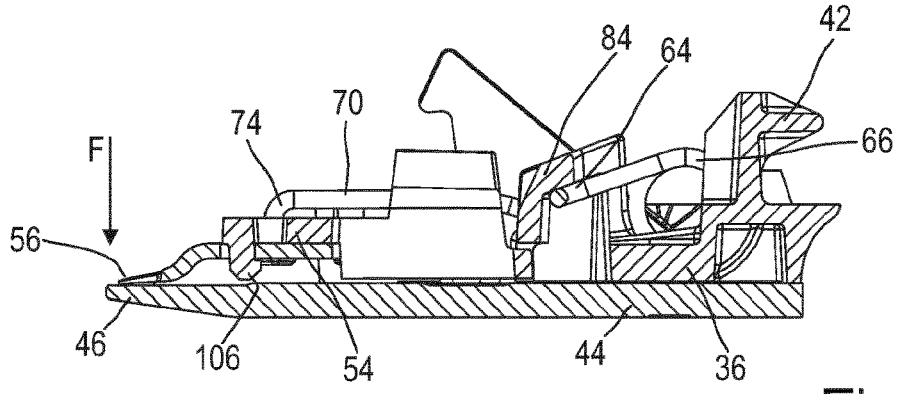
FIG. 10 shows a lateral cross-sectional view of the arrangement of FIG. 9 along the line X-X.
Figure 11:
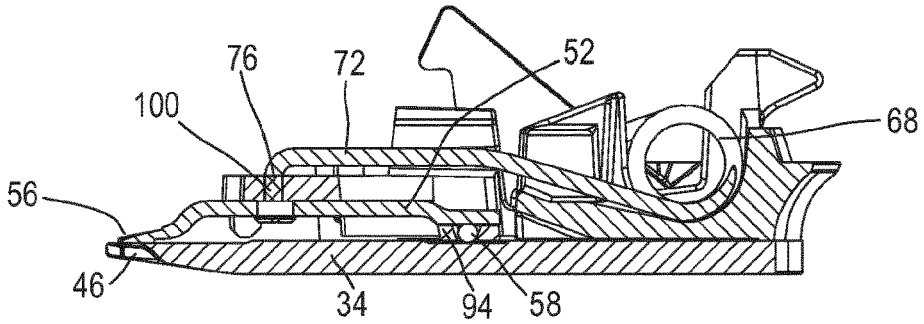
FIG. 11 shows another lateral cross-sectional view of the arrangement of FIG. 9 along the line XI-XI.
Figure 9:
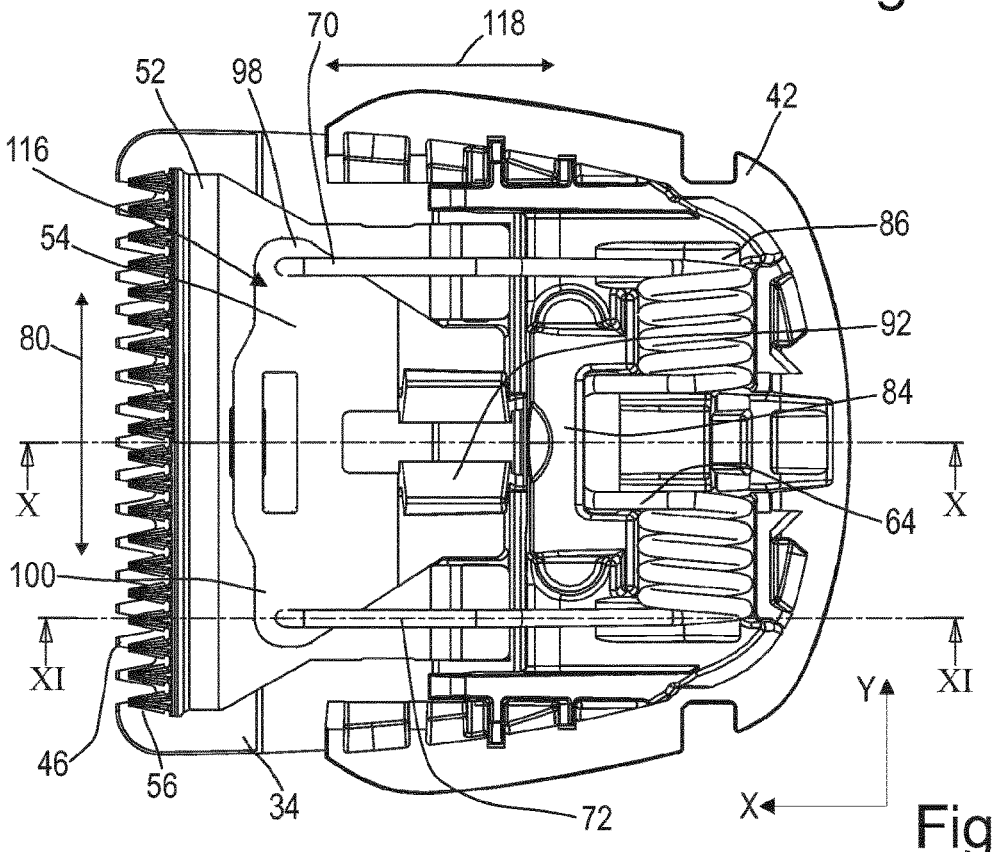
FIG. 9 shows a bottom view of the arrangement of FIG. 4.

With particular reference to FIG. 8 and with additional reference to FIGS. 9 to 11, an assembly state of the blade set assembly 16 is further detailed.

FIG. 9 is a bottom view of the assembled blade set assembly 16. FIG. 10 and FIG. 11 show respective lateral cross-sectional views along the lines X-X and XI-XI in FIG. 9. FIG. 10 shows a basically central cross-sectional view. FIG. 11 shows a cross-sectional view through a deflection arm 72 of the coupling element 62. In the views as shown in FIGS. 9, 10, and 11, the cutter blade 52 is shown in a neutral, central orientation, i.e. not displaced in the lateral direction Y.

It is preferred in at least some embodiments, that also in the assembled state a remaining force F generated by the coupling element 62 is present that urges the cutter blade 52 against the stationary blade 34 (refer to FIG. 10). Basically the same type of force F generated by the coupling element 62 and transferred by the deflection arm 70, 72 may be used, at the assembly stage, to penetrate the engagement regions 98, 100 of the contact bridge 54 and, at the operating stage, to ensure a tight fit sliding contact mating between the stationary blade 34 and the cutter blade 52.

FIG. 10 exemplifies a mounted state of the retaining portion 64 of the coupling element 62 which is mounted to or received at the retaining section 84 of the support part 36. Further, FIG. 10 exemplifies an engaged state of the snap-on feature 106 of the contact bridge 54. FIG. 11 exemplifies an engaged state of the insertion end 76 which is inserted in the engagement region 100 of the contact bridge 54. FIG. 11 further exemplifies a longitudinal guide arrangement between the stationary blade 34 and the cutter blade 52 which involves the bearing balls 58 and guide openings 94 provided by the contact bridge 54.

As can be best seen from FIG. 11, the insertion ends 74, 76 of the deflectable arms 70, 72 may extend through the entire height/wall thickness of the engagement regions 98, 100. This may involve a contact between frontal faces of the insertion ends 74, 76 and the cutter blade 52. However, in alternative embodiments, the insertion ends 74, 76 of the deflectable arms 70, 72 may not extend through the entire wall thickness of the engagement regions 98, 100. Hence, frontal faces of the insertion ends 74, 76 may be covered by plastic material at the engagement regions 98, 100. However, in still further exemplary embodiments, the insertion ends 74, 76 of the deflectable arms 70, 72 extend and protrude beyond the engagement regions 98, 100 towards the stationary blade 34. This may involve that the insertion ends 74, 76 engage respective recesses at the cutter blade 52.

Again, reference is made to FIG. 9. It can be best seen from the bottom view of FIG. 9 that the stationary blade 34, the cutter blade 52 and the coupling element 62 define a linkage mechanism 116 which resembles or is similar to a four-bar linkage mechanism that is basically arranged as a parallelogram linkage which may be also referred to as parallel double rocker linkage. A base bar of the linkage mechanism 116 is commonly defined by the base component 32 and those portions of the coupling element 62 that are fixedly received or supported thereon. Lateral bars of the linkage mechanism 116 are defined by the deflection arms 70, 72 of the coupling element 62. A movable bar that is basically arranged in a parallel fashion to the base bar is defined by the movable component 50, particularly the contact bridge 54 thereof, to which the deflection arms 70, 72 are connected by the insertion ends 74, 76. It has been observed that, in some embodiments, the insertion ends 74, 76 may rotate or swivel with respect to their recesses in the engagement regions 98, 100 that are formed through insertion. Hence, involved friction can be further reduced which ensures ease of movement at the involved joints of the linkage mechanism 116. Needless to say, at least some joints of the four-bar linkage mechanism 116 may be arranged as integral joints or living hinge joints and do not necessarily involve separate components that are arranged to be rotated with respect to one another.

Hence, the coupling element 62 that forms a major part of the linkage mechanism 116 also provides a guidance for the cutter blade 52 in a plane that is basically parallel to the longitudinal direction X and the lateral direction Y. Preferably, no further guide element for the reciprocating movement of the cutter blade 52 in the X-Y plane is provided (except for limit stops, etc.). As already discussed above, the coupling element 62 further provides for a defined, slightly preloaded mating or contact between the stationary blade 34 and the cutter blade 52 and therefore urges the cutter blade 52 in the height/vertical direction Z against the stationary blade 34.

When a driving movement is transferred to the stationary blade 34 via the follower 92 of the contact bridge 54, a reciprocating movement of the cutter blade 52 with respect to the stationary blade 34 is induced. A major component of the reciprocating movement is a lateral movement, refer to the double arrow 80 in FIG. 9. However, due to the design of the linkage mechanism 116, also a small movement component in the longitudinal direction X is present, refer to the double arrow 118 of FIG. 9.

Hence, the reciprocating movement of the cutter blade 52 involves a slightly curved movement path, wherein the cutter blade 52, however, maintains the parallel orientation with respect to the stationary blade 34.

Figure 12:
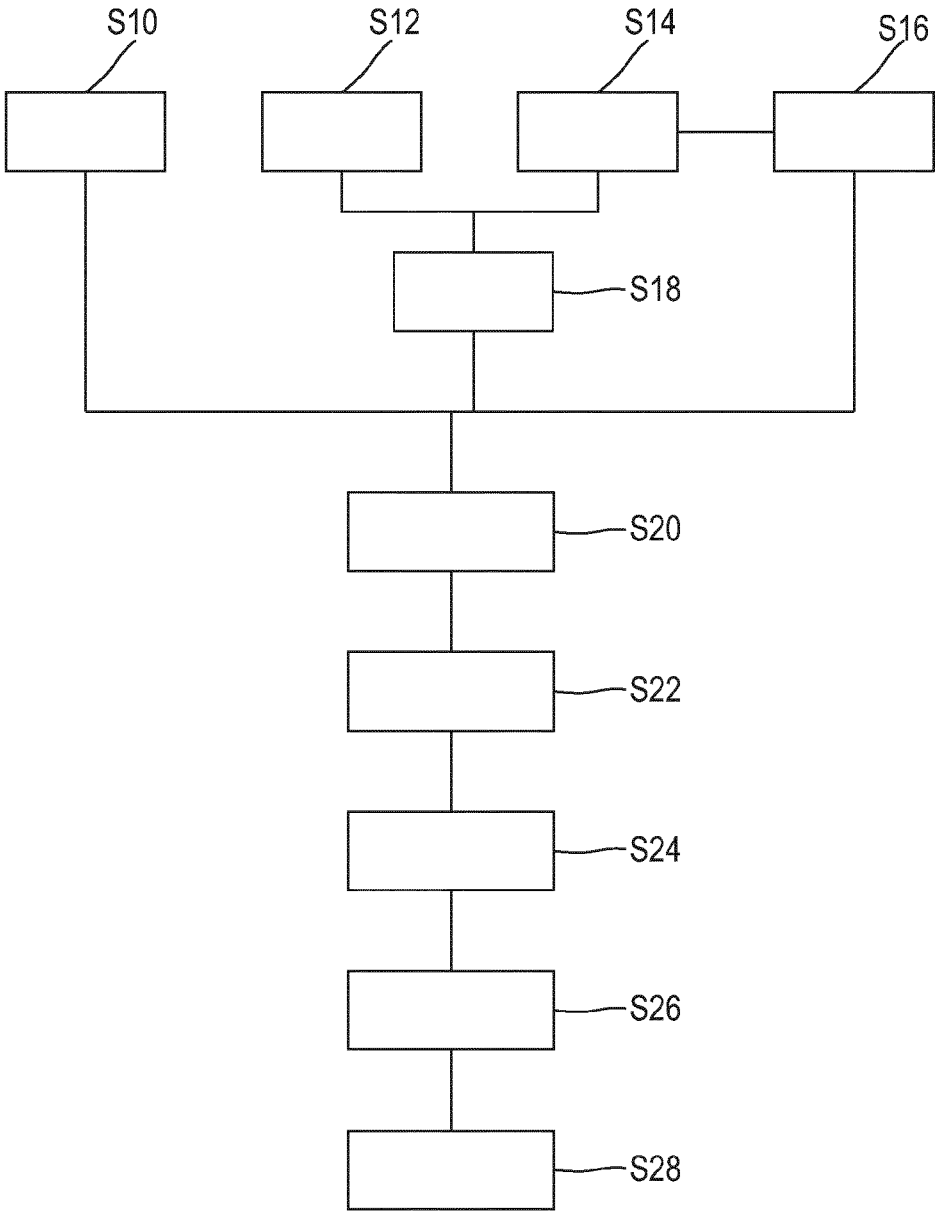
FIG. 12 shows a simplified block diagram of an embodiment of a method of manufacturing a blade set assembly.

Further reference is made to FIG. 12 which is a block diagram illustrating several steps of an exemplary embodiment of a method of manufacturing a blade set assembly.

The method involves a step S10 which includes the provision of a base component which preferably comprises a stationary blade. The base component may further comprise a support part.

Another step S12 includes providing a movable component which preferably comprises a cutter blade. In at least some embodiments as discussed herein, a further step S16 is provided which involves the provision of a plastic contact bridge. However, in alternative embodiments, the step S14 may be already implemented in the step S12 as the plastic contact bridge may form a part of the movable component.

Further, a step S16 is provided which involves the provision of a coupling element. Preferably, the coupling element is arranged as a flexible coupling element, particularly as a leg spring.

An optional step S18 may follow which involves an attachment of the contact bridge to the movable component, particularly to the cutter blade thereof. Attaching the contact bridge may involve a snap-on attachment. Hence, in the step S18 a further assembled movable component may be formed.

A further assembly step S20 may follow which involves an arrangement of the base component, the movable component and the coupling element in a desired assembly orientation. For instance, the coupling element may be received at the base component in such a way that an auxiliary mounting force urging the movable component against the base component is induced.

In a further step S22 which may be also referred to as gaging step, teeth of the stationary blade and the cutter blade may be positioned at a defined relative assembly position so as so set a tip-to-tip distance therebetween. This may involve providing a respective assembly gage for the desired relative orientation between the stationary blade and the cutter blade.

In a further, optional step S24, the contact bridge is at least partially directly or mediately heated. This may for instance involve an indirect heating via respective insertion ends of the coupling element that contact respective to-be-heated portions of the contact bridge. The step S24 may for instance involve applying friction heating, particularly ultrasonic heating to the insertion ends. In the alternative, the step S24 may involve applying laser heating. Needless to say, at least in some embodiments, the step S24 involves a direct heating of potential engagement portions of the contact bridge.

The step S24 may be followed by a further step S26 which involves an at least partial softening of the contact bridge, particularly in the vicinity of the insertion ends. Hence, the steps S24 and S26 may be interrelated as the plastic material of the contact bridge may be softened through heating.

A further step S28 may involve driving or inserting the insertion ends of the coupling element into the contact bridge so as to bond the two components to one another. Preferably, a certain pretension is present at the coupling element which enables the coupling element to penetrate the contact bridge by itself, i.e. without the need of additional external penetrations forces applied by actuators.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A blade set assembly for a hair cutting appliance, the blade set assembly comprising:

a stationary blade, a cutter blade, a flexible coupling element including at least one insertion end and at least one retaining portion, and a plastic contact bridge, wherein the stationary blade and the cutter blade are arranged at a defined relative assembly position, wherein the plastic contact bridge is attached to the cutter blade, wherein the at least one retaining portion of the coupling element is attached to the stationary blade, and wherein the at least one insertion end of the coupling element is driven into the plastic contact bridge in a material-displacing fashion, thereby displacing material of the plastic contact bridge and securing the assembly position between the stationary blade and the cutter blade.

2. The blade set assembly as claimed in claim 1, wherein the coupling element is arranged as a leg spring comprising at least one deflection arm and at least one resilient portion arranged between the at least one retaining portion and the at least one deflection arm, wherein the at least one insertion end is arranged at an end of the at least one deflection arm, and wherein the coupling element urges the stationary blade and the cutter blade against one another.

3. The blade set assembly as claimed in claim 1, wherein the coupling element, the stationary blade and the cutter blade define a linkage mechanism that defines, during operation of the blade set assembly, a parallel relative movement between the stationary blade and the cutter blade, and wherein the coupling element comprises two deflection arms that correspondingly extend between the at least one retaining portion and the at least one insertion end and that connect the stationary blade and the cutter blade.

4. The blade set assembly as claimed in claim 1, wherein the plastic contact bridge is a cam follower element, and wherein the at least one retaining portion of the coupling element is attached to a retaining section of the stationary blade.

5. The blade set assembly as claimed in claim 1, comprising:

a support part attached to the stationary blade, wherein the at least one retaining portion of the flexible coupling is attached to the stationary blade through the support part.

6. The blade set assembly as claimed in claim 5, wherein the support part includes a retaining section, and wherein the at least one retaining portion of the flexible coupling is attached to the retaining section of the support part.

7. The blade set assembly as claimed in claim 1, comprising:

wherein the plastic contact bridge includes a snap-on hook, wherein the cutter blade defines a hole through the cutter blade, wherein the hole is sized to receive the snap-on hook, and wherein the plastic contact bridge is attached to the cutter blade by the snap-on hook being received by the hole through the cutter blade.

8. A hair cutting appliance comprising a blade set assembly as claimed in claim 1.

9. A method of assembling a blade set assembly for a hair cutting appliance, the method comprising acts of:

arranging a stationary blade having a series of teeth and a cutter blade having a series of teeth at a defined relative assembly position, and securing the assembly position between the stationary blade and the cutter blade, involving:

attaching a plastic contact bridge to cutter blade, attaching a retaining portion of a flexible coupling element to the stationary blade, and penetrating a non-perforated section of the plastic contact bridge with at least one insertion end of the coupling element such that plastic material of the plastic contact bridge is displaced by the at least one insertion end of the coupling element.

10. The method as claimed in claim 9, wherein the coupling element, in the secured assembly position, defines an offset between the series of teeth of the stationary blade and the series of teeth of the cutter blade.

11. The method as claimed in claim 9, wherein the coupling element is a spring element, and wherein the at least one insertion end, in the penetrated state, forms a joint with the cutter blade.

12. The method as claimed in claim 9, wherein the act of penetrating the plastic contact bridge involves:

at least partially softening the non-perforated section of the plastic contact bridge, and penetrating the plastic contact bridge at the softened non-perforated section.

13. The method as claimed in claim 12, wherein a resulting position of the penetrating of the plastic contact bridge is dependent on the defined relative assembly position of the stationary blade and the cutter blade.

14. The method as claimed in claim 12, wherein the at least one insertion end of the coupling element is heated, and wherein the coupling element, in the heated state of the at least one insertion end, softens the non-perforated section of the plastic contact bridge.

15. The method as claimed in claim 12, wherein the act of at least partially softening the non-perforated section of the plastic contact bridge involves heating the at least one insertion end of the coupling element, and wherein the heating the at least one insertion end involves laser heating or friction heating.

16. The method as claimed in claim 9, wherein prior to the act of penetrating, the coupling element is arranged in a pretension mounting position which induces an insertion force that urges the at least one insertion end into the plastic contact bridge during the penetrating act.

17. The method as claimed in claim 9, wherein the coupling element, in the secured assembly position, urges the cutter blade into a defined lateral guidance and close fit configuration with the stationary blade.

18. The method as claimed in claim 9, wherein the at least one insertion end of the coupling element comprises a first insertion end of the coupling element and a second insertion end of the coupling element, wherein the act of penetrating the non-perforated section of the plastic contact bridge comprises penetrating the plastic contact bridge with the first insertion end of the coupling element, and penetrating the plastic contact bridge with the second insertion end of the coupling element, wherein resulting penetration spots of the first and second insertion ends of the coupling element are spaced from one another in such a way that a linkage mechanism for a defined relative movement between the stationary blade and the cutter blade is formed.

19. The method as claimed in claim 9, comprising an act of:

attaching a support part to the stationary blade, wherein attaching the retaining portion of the flexible coupling comprises attaching the retaining portion of the flexible coupling to the support part.

20. The method as claimed in claim 19, wherein the support part includes a retaining section, and wherein attaching the at least one retaining portion of the flexible coupling comprises attaching the at least one retaining portion of the flexible coupling to the retaining section of the support part.

* * * * *